US006453814B2

(12) United States Patent
Oepen et al.

(10) Patent No.: US 6,453,814 B2
(45) **Date of Patent: *Sep. 24, 2002**

(54) DEVICE AND PROCESS FOR TRANSVERSE SIZING OF PRINTED PRODUCTS

(76) Inventors: Martin Christian Oepen, Industriestrasse 17, 52459, Inden Pier (DE); Ralf Erich Ohlef, Nordstr. 115, 52353, Düren (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/321,073

(22) Filed: May 27, 1999

Related U.S. Application Data

(60) Provisional application No. 60/086,851, filed on May 27, 1998.

(51) Int. Cl.[7] ..... B41F 35/00

(52) U.S. Cl. ..... 101/424.2; 239/222; 239/225.1; 118/313; 118/DIG. 15; 401/197; 401/220

(58) Field of Search ..... 492/12, 46, 30; 239/222, 225.1, 248, 249, 383, 389, 550, 551, 554; 118/216, 223–227, 230, 233, 244, 258, 259, DIG. 15, 202, 203, 255, 302, 313, 314, 315, 324, 325, 323, DIG. 17; 101/119, 424.2; 401/21–23, 196, 197, 203–206, 208, 219, 220; 427/211, 428

(56) References Cited

U.S. PATENT DOCUMENTS

| | | | | | |
|---|---|---|---|---|---|
| 2,828,553 | A | * | 4/1958 | Jarosz | 34/122 |
| 4,665,723 | A | * | 5/1987 | Zimmer | 101/120 |
| 5,099,758 | A | * | 3/1992 | Hassler et al. | 101/120 |
| 5,525,751 | A | * | 6/1996 | Niederkorn | 118/423 |
| 5,569,326 | A | * | 10/1996 | Ruhl | 118/205 |
| 5,843,230 | A | * | 12/1998 | Potjer et al. | 118/407 |

* cited by examiner

*Primary Examiner*—Eugene Eickholt
(74) *Attorney, Agent, or Firm*—Collard & Roe, P.C.

(57) ABSTRACT

A device for transversely sizing printed products that uses individual application devices such as nozzles that are provided on a roller. The method includes moving individual application devices in at least one sizing position where the relative speed between the application device and printed product is held at essentially zero.

6 Claims, 2 Drawing Sheets

DEVICE AND PROCESS FOR TRANSVERSE SIZING OF PRINTED PRODUCTS

This application is based on provisional application No 60/086,851 filed on May 27, 1998, the priority date benefit which is claimed under 35 U.S.C. 35 §119(e).

BACKGROUND OF THE INVENTION

1. Field of the Invention

This invention relates to a device for transverse sizing of printed products such as in a rotary offset press, and for a corresponding process for sizing the printed products.

2. The Prior Art

In the prior art, there are roller transverse sizing units with a perforated plate, in which the holes are mechanically opened in a sizing position by a common seal. This system has the disadvantage that it can get dirty very easily and requires a great deal of servicing due to the common seal for all of the holes. Furthermore, this system is complex and expensive. In addition, the sizing is simply pressed out of the holes with this system, which also causes a great deal of soiling. Moreover, the sizing is always applied over the entire length of the set of holes.

Other prior art devices include electronically-controlled nozzle transverse sizing units with individual seals of a sizing application device. These nozzle transverse sizing units are static in relation to the moving printed product, so that a satisfactory pattern can be applied only up to certain speeds due to the mechanical and electrical tolerances of the application devices and the tear-off behavior of the sizing dots.

SUMMARY OF THE INVENTION

It is therefore an object of the present invention to provide a device and a process for transverse sizing of printed products that is easy to service and produces sizing of a high quality.

These and other objects of the invention are accomplished by a device for transversely sizing printed products that uses individual application devices that are provided on a roller. The method includes moving individual application devices in at least one sizing position where the relative speed between the application devices and printed product is held at essentially zero.

In the present context, "individual application devices" comprise each component of an application device that contacts the sizing and can be removed individually from a roller for servicing, and which can be attached to the roller independent of other application devices. In particular, these can be individual nozzles or nozzle heads or parts.

To make servicing easier, at least one exchangeable holder is provided on the roller for at least one applicator. There can also be several applicators in the holder. An exchangeable module can be provided in the roller that has at least two holders. With this arrangement, cleaning is made easier and one can adapt to changed conditions. The down time required for such jobs is reduced and the machine time is thus increased.

The flexibility of the arrangement according to the invention can be increased when the applicators are individually controllable or controlled. Without constructional measures, the manner in which the sizing is applied by the individual applicators and the length of the sizing path can be adapted. In particular, the individual control of the applicators allows the applicators to be supplied with sizing by a common feed without abandoning the advantages of the invention.

Depending on the requirements, the individual applicators can be controlled in groups or blocks to reduce the complexity of the controlling. Simple and flexible control is achieved by electrically controlling at least one of the applicators.

The risk of soiling can be further reduced if the applicators spray the sizing onto the printed product. This is best achieved by nozzles. If the nozzles are electrically controlled, the applied sizing can be easily and precisely dosed. The nozzles can also have a pump that transports the sizing in response to an electrical control. This can provide particularly fine and finely adjusted dosing.

To reduce impurities, the nozzles apply the sizing without contacting the printed product. Alternatively, application with contact is also possible.

To prevent the nozzles from drying out or to reduce drying when the device is not used, a gate is provided for covering the nozzles. A gate can be used for all or some of the nozzles and is actuated by a pneumatic actuator.

The sizing is applied evenly when the applicator is moved synchronous with the movement of the printed product. This can be guaranteed when the roller with the applicators is rotated at a corresponding speed.

The device and process are particularly simple when the roller is designed to retain the format of the printed product, i.e., when the perimeter of the roller is a non-fractional multiple of the length of the printed product, or the length of the printed product corresponds to a non-fractional multiple of the roller perimeter. Preferably, the perimeter of the roller identically corresponds to the format of the printed product.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
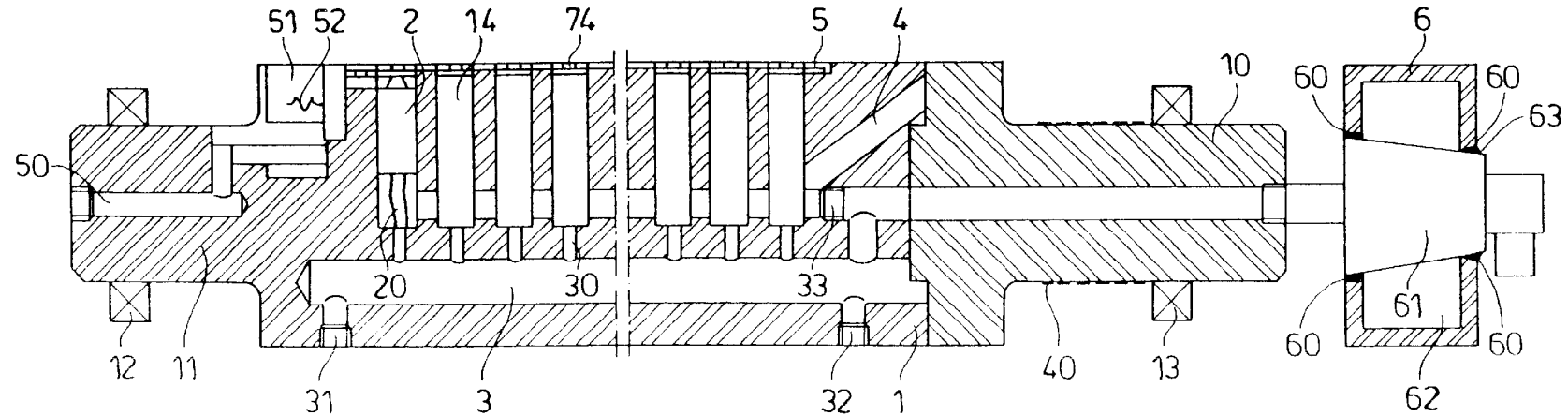
FIG. 1 shows a section of the roller according to the invention.
Figure 2:
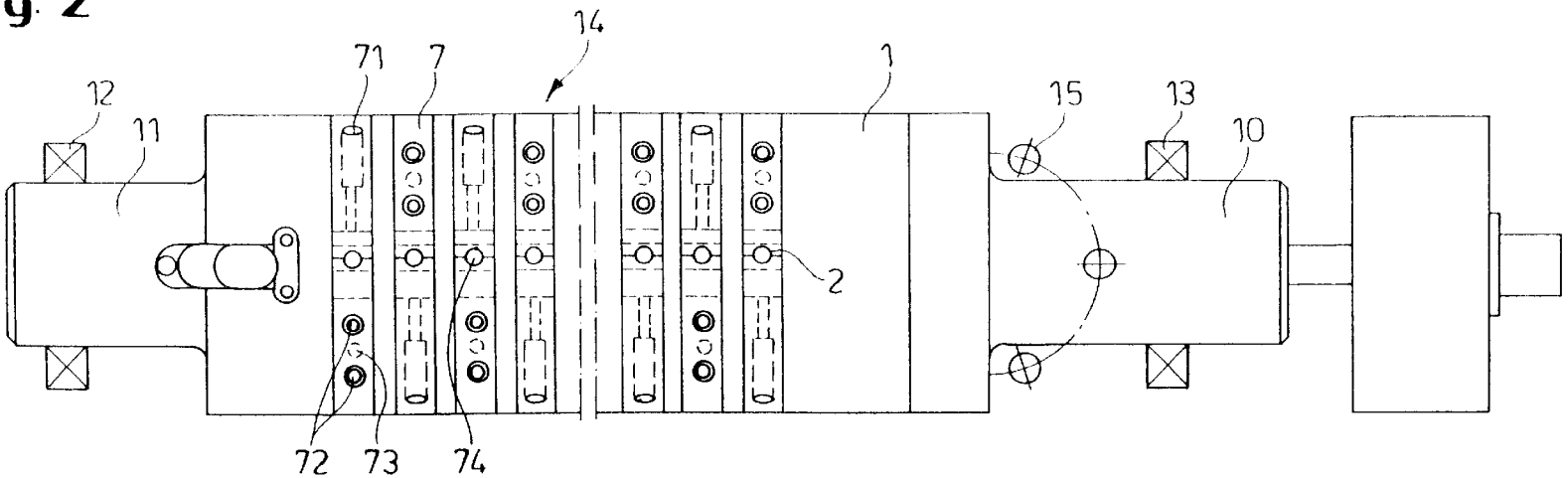
FIG. 2 shows a top view of the cylinder shown in FIG. 1.
Figure 3C:
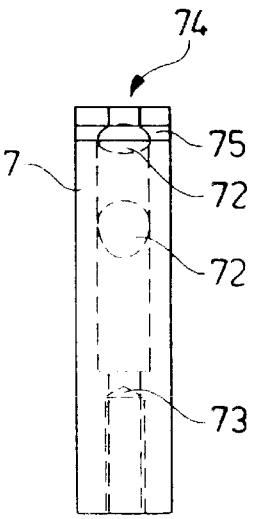
FIG. 3C shows a section of the holder viewed along line IIIC in FIG. 3B.
Figure 3B:
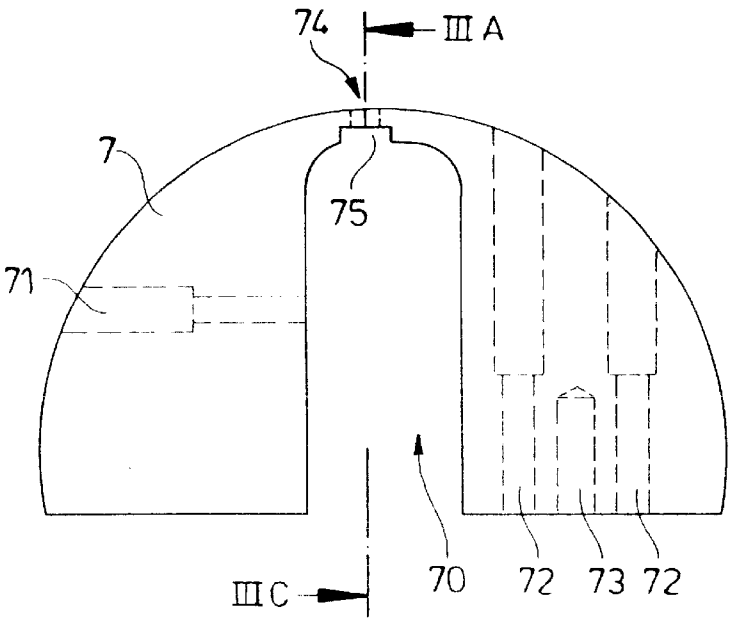
FIG. 3B shows a side view of the holder.
Figure 3D:
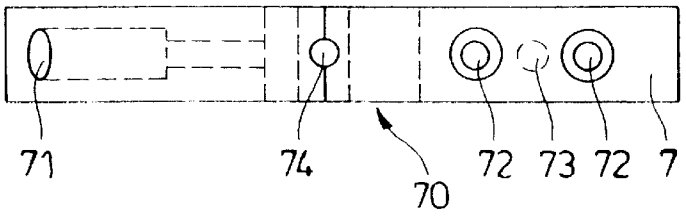
FIG. 3D shows a top view of the holder.
Figure 3A:
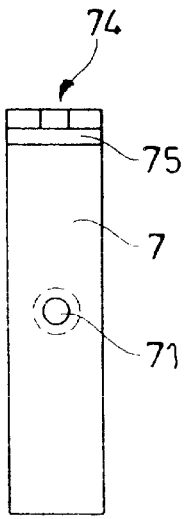
FIG. 3A shows a holder for a nozzle in the roller of FIG. 1, along line IIIA in FIG. 3B.

Referring now in detail to the drawings and, in particular, FIGS. 1 and 2, there is shown a roller 1 that allows sizing to be applied to a printed product without contacting it and at different viscosities, by spraying the sizing onto the printed product.

The design and construction of roller 1 allows the mounting of various types of nozzles 2 that serve as applicators. This makes the use of roller 1 very flexible.

Nozzles 2 are supplied with sizing by a common feed 3 that extends from a right neck 10 of roller 1 to nozzles 2. From the sizing feed 3, individual feed holes 30 extend to nozzles 2 via tubes 20. The connection of tubes 20 to feed holes 30 is a plug connection. Sizing feed 3 has two openings that are closed by screws 31 and 32. These openings serve to rinse sizing feed 3.

Roller 1 also has a cable 4 that holds electrical control lines of slip rings 40 to nozzles 2. For manufacturing reasons, cable 4 is separated by a screw 33 from sizing feed 3.

Each of nozzles 2 are individually controlled via the electrical control lines and slip rings 40. However, several nozzles 2 can be connected to a slip ring 40 or to a control line.

On the left neck 11 of roller 1, there is a supply connection 50 for pneumatic elements. The air supplied by the pneumatic devices and a corresponding compressed air tank 51 allow a gate 5 to be actuated. Gate 5 is controlled when the system is not operating so that the used nozzles 2 do not dry out and clog. Gate 5 is kept in its resting position by a spring 52.

Roller 1 is held at its necks 10 and 11 by bearings 12 and 13, and is driven by a toothed belt (not shown). Before the sizing is fed to roller 1, it is guided through a cooling system 6. Cooling system 6 comprises a water reservoir 62 in which a passage cone 61 is sealed by 0-rings 60. Passage cone 61 is held by a counter ring 63 to the water reservoir 62. A constant water flow is guided through the water reservoir 62 to guarantee uniform cooling.

Nozzles 2 are located in recesses 14 of roller 1. The nozzles are held in recesses 14 by holders 7 that are fixed to roller 1. As shown in FIGS. 3A–3D, each holder 7 has a central recess 70 in which a corresponding nozzle 2 can be fixed in holder 7. Holder 7 is fixed to roller 1 via holes 72 and a threaded hole 73, into which corresponding screws can be screwed.

Each of holders 7 has an opening 74 at its top end through which the respective nozzle 2 can spray sizing. At opening 74 there is an essentially rectangular, smaller recess 75 at the side of recess 70 in which gate 5 is located.

The modular design allows roller 1 to be easily adapted to any situation. The plug connections of the electrical control lines and the sizing feed allow nozzles 2 to be easily exchanged or simply left out. In addition, the electrical control of individual nozzles allows the nozzles 2 to not be actuated as needed.

Several nozzles 2 can be placed in one holder 7. In particular, it is also possible to combine several holders 7 to form a single holder or to connect them in a module. In the present embodiment, such a module is formed by the left roller side 11 that is connected to the right roller side 10 by a screw connection 15, shown schematically in FIG. 2. Screw connection 15 can be simply undone and left roller side 11 replaced by another roller side.

Accordingly, while only a single embodiment of the present invention has been shown and described, it is obvious that many changes and modifications may be made thereunto without departing from the spirit and scope of the invention.

What is claimed is:

1. A device for transversely applying sizing to printed products, comprising:

a plurality of individual applicator devices provided on a roller, said applicator devices comprising nozzles for spraying sizing onto the printed products, wherein said nozzles are arranged with a spacing from the printed products and do not contact the printed products at all during spraying, and wherein said printed products move at a speed during the sizing and the roller rotates at a speed corresponding to the speed of the printed products.

2. A device for transversely applying sizing to printed products, comprising:

a plurality of individual applicator devices provided on a roller, said applicator devices comprising nozzles for spraying sizing onto the printed products, wherein said printed products move at a speed during the sizing and the roller rotates at a speed corresponding to the speed of the printed products and wherein at least one of the applicator devices is controlled electrically.

3. A device for transversely applying sizing to printed products, comprising:

a plurality of individual applicator devices provided on a roller, said applicator devices comprising nozzles for spraying sizing onto the printed products, wherein said printed products move at a speed during the sizing and the roller rotates at a speed corresponding to the speed of the printed products; and an exchangeable module mounted on the roller and having at least two holders, wherein a first of said at least two holders holds at least one first of said applicator devices and a second of said at least two holders holds at least one second of said applicator devices.

4. A device for transversely applying sizing to printed products, comprising:

a plurality of individual applicator devices provided on a roller, said applicator devices comprising nozzles for spraying sizing onto the printed products, wherein said printed products move at a speed during the sizing and the roller rotates at a speed corresponding to the speed of the printed products, and wherein the roller has a common sizing feed leading to the applicator devices, and wherein at least some of the applicator devices are controlled in groups.

5. A device for transversely applying sizing to printed products, comprising:

a plurality of individual applicator devices provided on a roller said applicator devices comprising nozzles for spraying sizing onto the printed products, wherein said printed products move at a speed during the sizing and the roller rotates at a speed corresponding to the speed of the printed products, and wherein a sizing feed has at least one sealable opening for rinsing said sizing feed.

6. A device for transversely applying sizing to printed products, comprising:

a plurality of individual applicator devices provided on a roller, said applicator devices comprising nozzles for spraying sizing onto the printed products, wherein said printed products move at a speed during the sizing and the roller rotates at a speed corresponding to the speed of the printed products; and a cooling system for the sizing comprising a water reservoir having a passage cone sealed by O-rings, wherein a constant water flow is guided through said water reservoir to guarantee uniform cooling.

* * * * *